US005211304A

United States Patent [19]

Stolzman

[11] Patent Number: 5,211,304

[45] Date of Patent: May 18, 1993

[54] CLOSURE ASSEMBLY

[76] Inventor: Michael D. Stolzman, 28468 N. Ballard Dr., Lake Forest, Ill. 60045

[21] Appl. No.: 861,097

[22] Filed: Mar. 31, 1992

[51] Int. Cl.[5] ..... B65D 53/00

[52] U.S. Cl. ..... 220/304

[58] Field of Search ..... 220/304, 308; 215/352

[56] References Cited

U.S. PATENT DOCUMENTS

| | | | |
|---|---|---|---|
| 1,324,896 | 12/1919 | Hettinger | 215/352 X |
| 2,291,706 | 8/1942 | Frease | 220/304 X |
| 2,445,802 | 7/1948 | Robinson | 220/304 |
| 2,769,566 | 11/1956 | Thompson | 220/304 X |
| 3,122,262 | 2/1964 | Hagmann et al. | 220/304 |
| 4,005,799 | 2/1977 | Mannaerts | 220/304 X |
| 4,078,696 | 3/1978 | Crisci | 220/308 |
| 4,146,207 | 3/1979 | Rofe | 220/304 X |

*Primary Examiner*—Allan N. Shoap
*Assistant Examiner*—Nova Stucker
*Attorney, Agent, or Firm*—Wood, Phillips, Van Santen, Hoffman & Ertel

[57] ABSTRACT

A closure assembly has a closure element which is releasably engaged with a shipping and storage container for selectively restricting the flow of fluid through a discharge outlet in the container. The closure element has a longitudinal axis with a first axial end received in the opening and a second axial end having a peripheral flange outside the container. An axially opening slot with oppositely inclined sidewalls is provided in the peripheral flange for seating an annular seal member, whereby the seal member is captured in sealing relation between the peripheral flange and the container for reducing leakage through the outlet. The seal member is a deformable ring which has an undeformed state in which a first surface on the ring engages an end wall of the slot and an arcuate second surface on the ring extends beyond the axial opening.

16 Claims, 1 Drawing Sheet

CLOSURE ASSEMBLY

BACKGROUND OF THE INVENTION

1. Technical Field

The present invention relates generally to a closure assembly for a shipping and storage container, and more particularly toward a closure assembly for reducing leakage through a discharge outlet in a fluid containing vessel.

2. Background Art

Shipping and storage containers which have a cylindrical drum and removable lid are generally well known for reliably storing and/or transporting a variety of materials. In order to fill the drums, the lid is removed to define an opening in one end face of the drum and material is introduced into the drum. After filling is completed, the lid is replaced and appropriately secured to the drum to seal the drum and prevent the contents from spilling or otherwise escaping during storage and/or transportation of the drum.

In applications where a portion of the contents is to be emptied from the sealed drum, the drum is provided with a discharge outlet. A suitable closure element, such as a threaded plug, is received in the discharge outlet for preventing the undesired escape of the contents of the drum. When it is desired dispense a portion of the contents, the closure element is removed and material flows through the outlet under the effect of gravity. An atmospheric pressure-admitting inlet often is provided to facilitate the dispensing process.

The manner in which a closure element engages the drum opening can contribute to excessive leakage through the opening, even when the closure element is properly installed. As a result, prior closure elements have a rubber annular washer between the closure element and the drum.

In one known material container, a closure element has a cylindrical threaded plug with an oversized axial end. The plug is receivable in an internally threaded upstanding boss in a drum and has a rectangular radially outward opening groove adjacent the oversized end. A generally flat annular washer is provided and has a radially inward directed lip which is seated in the rectangular groove in the plug. When the plug is tightened into engagement with the container, the washer is held between the oversized end of the closure element and the boss.

Due to limited engagement of the lip on the washer with the plug, the washer is susceptible to falling off the boss and breaking the seal between the closure element and the drum. In addition, if the washer is not completely flat or does not have a uniform thickness, the washer will not seal around the total periphery of the boss and can permit unacceptable levels of leakage through the discharge outlet. The present invention is directed toward overcoming the problem set forth above.

SUMMARY OF THE INVENTION

It is an object of the present invention, therefore, to provide a new and improved closure assembly for reducing leakage through a discharge outlet in a shipping and storage container.

In the exemplary embodiment, a closure assembly has a closure element which is releasably engaged with a shipping and storage container for selectively restricting the flow of fluid through a discharge outlet on the container. The closure element has a longitudinal axis with a first axial end received in the outlet and a second axial end having a peripheral flange outside the container. The peripheral flange has an axially downward opening slot for seating an annular seal member, whereby the seal member is captured in sealing relation between the peripheral flange and the container for reducing leakage through the outlet.

The closure element is made of plastic and has an externally threaded cylindrical end received in a circular boss on the container. The peripheral flange extends radially from the second axial end of the closure element and has a knurled circular outer edge. A central opening in the second axial end of the closure element has a series of peripherally spaced notches whereby a tool is receivable in the notches and can be used for disengaging the closure element from the container.

The axially opening slot comprises an annular groove in the peripheral flange and has a pair of spaced apart, oppositely inclined sidewalls. The slot opens downwardly in a direction facing the container and has an end wall spaced axially from the opening, with the slot further having a depth characterized by the distance between the end wall and the axial opening.

In the exemplary embodiment, the seal member is a deformable rubber ring having an undeformed state in which a first surface on the ring engages the end wall and a second surface on the ring extends beyond the axial opening. Preferably, the seal member has a substantially circular cross section with a diameter greater than the depth of the axially opening slot. As a result, the surface of the seal member which extends beyond the axial opening of the slot has substantially circular curvature.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and advantages, may be best understood by reference to the following description taken in conjunction with the accompanying drawings, in which like reference numerals identify like elements in the figures and in which:

DESCRIPTION OF THE PREFERRED EMBODIMENT

Figure 1:
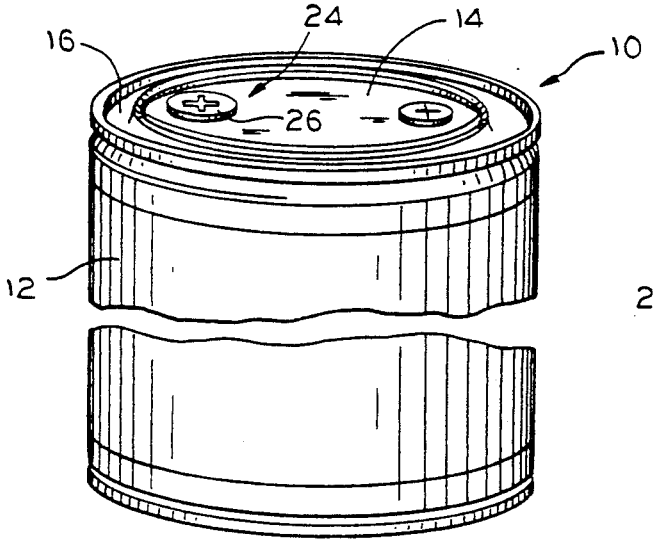
FIG. 1 is a perspective view of a shipping and storage container having a closure assembly according to the present invention.
Figure 2:
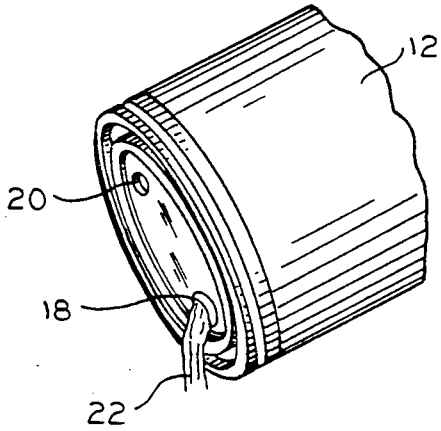
FIG. 2 is a diagrammatic illustration showing the manner in which fluid is discharged from the container shown in FIG. 1.
Figure 3:
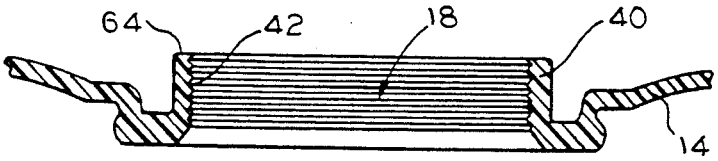
FIG. 3 is an enlarged fragmentary section showing a boss on the lid of a shipping and storage container.
Figure 4:
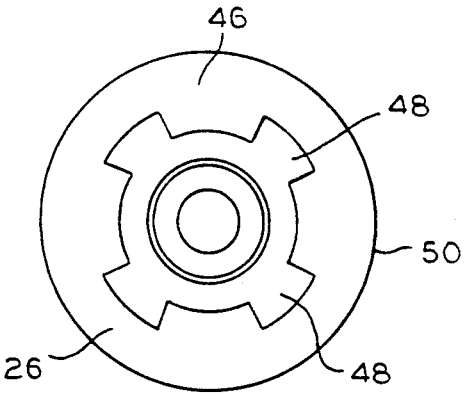
FIG. 4 is a top view of a closure element in the present closure assembly.
Figure 5:
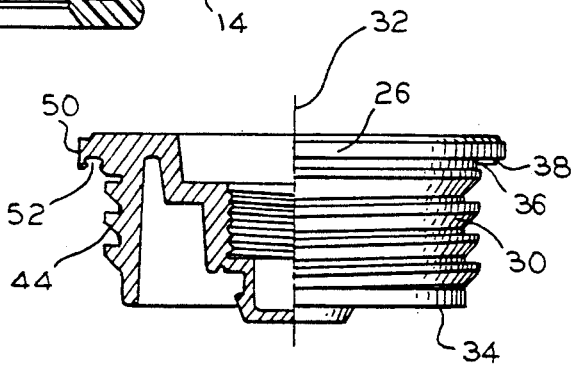
FIG. 5 is a broken out sectional side view of the closure element illustrated in FIG. 4.
Figure 6:
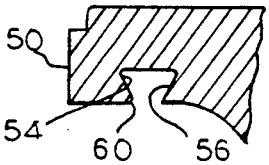
FIG. 6 is a fragmentary sectional view illustrating an axially opening slot in the closure element.
Figure 7:
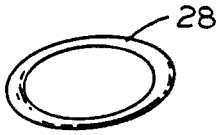
FIG. 7 is a perspective view of a seal member.

FIGS. 1 and 2 illustrate a conventional shipping and storage container, generally designated 10, having a cylindrical drum 12 and a circular lid 14. The lid 14 is secured to an axial end face 16 of the drum 12 and preferably can be removed for filling the drum.

The lid 14 has a discharge outlet 18 and an atmospheric pressure-admitting inlet 20 for facilitating the discharge of fluid 22 under the effect of gravity when the drum 12 is tipped. A closure assembly according to the present invention, generally designated 24, is provided for reducing unintended leakage of the fluid 22 and associated vapors through the discharge outlet 18.

More specifically, and referring also to FIGS. 3–9, the closure assembly 24 comprises a closure element 26 and an annular seal member 28.

The closure element 26 is formed of molded plastic and has a cylindrical hub 30 coaxial with a longitudinal axis 32. As will be described further below, the cylindrical hub 30 has a first axial end 34 which is received in the discharge outlet 18 and a second axial end 36 which extends outwardly of the lid 14. An annular peripheral flange 38 is molded integrally with the cylindrical hub 30 and extends radially from the second axial end 36 thereof.

The lid 14 is provided with an axially upward extending cylindrical boss 40 (FIG. 3) having an internally threaded side wall 42. It can be seen that the axially outer face of the boss 40 defines the discharge outlet 18. While the boss 40 is presently shown on a removable lid 14, it should be noted that the present invention envisions applications wherein a discharge outlet 18 is provided in an integral end face of a fluid containing drum. Moreover, the discharge outlet also may be disposed on the cylindrical sidewall of a drum.

A series of helical threads 44 extend around the periphery of the cylindrical hub 30 on the closure element 26 and are complementary to the threads formed on the inner sidewall 42 of the boss 40. When the first axial end 34 of the closure element 26 is received in the discharge outlet 18, rotation of the closure element 26 relative to the lid 14 induces axial advancement of the cylindrical hub 30 through the outlet 18 as a result of the coaction between the threads 42 and 44.

To facilitate releasable engagement of the closure element 26 with the lid 14, an end face 46 of the peripheral flange 38 has a series of circumferentially spaced notches 48 (FIG. 4) whereby an appropriate tool is receivable in the notches 48 and can be used for rotating the closure element 26 relative to the boss 40. In addition, the flange 38 has a substantially circular knurled outer edge 50 which can be easily grasped for manipulating the closure element 26.

The description provided hereinabove with respect to shipping and storage container 10 relates to generally well-known means for reliably storing and/or transporting a variety of materials. The inventive features which make up the presently claimed subject matter will now be described.

Referring to FIGS. 5–8, the peripheral flange 38 has an axially opening slot 52 which extends around the periphery of the flange and seats the seal member 28. The slot 52 comprises an annular groove having a dovetail construction, that is to say, the slot 52 has a pair of oppositely inclined sidewalls 54 and 56. The slot 52 has an end wall 58 intermediate the sidewalls 54 and 56 and spaced axially from a downwardly directed opening 60.

Figure 8:
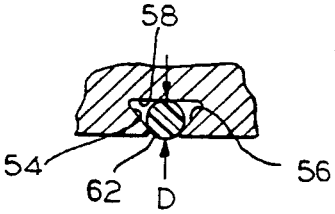
FIG. 8 illustrates the axially opening slot shown in FIG. 6 with the seal member seated in the slot in an undeformed state; and, FIG. 9 illustrates an alternative embodiment of a seal member seated in the slot.

The seal member 28 in one form comprises a deformable rubber O-ring having a generally circular cross section of diameter D. The diameter D of the rubber O-ring is selected such that when the O-ring is in an undeformed state and seated against end wall 58, an arcuate portion 62 extends axially outward beyond the opening 60 in the axially opening slot 52 (FIG. 8). Moreover, the cross-sectional diameter of the seal member 28 is greater than the width of the downwardly directed opening 60. Consequently, engagement of the sidewalls 54 and 56 with the seal member 28 retains the seal member in the opening 60 before the closure element 26 is engaged with the discharge outlet 18.

The axially extending arcuate portion 62 of the rubber O-ring contributes to the efficiency with which the closure assembly 24 operates. As noted above, the O-ring is seated in the axially opening slot 52 in the peripheral flange 38 of the closure element 26. As the cylindrical hub 30 of the closure element 26 is axially advanced through the discharge outlet 18, the O-ring is captured in sealing relation between the flange 38 and the lid 14 to reduce leakage through the outlet. The axially outward extending portion 62 of the O-ring is compressed into engagement the entire periphery of the axial face 64 on the boss 40 when the hub 30 of the closure element is fully received in the boss.

Figure 9:
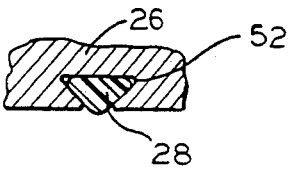

In an alternative embodiment illustrated in FIG. 9, the seal member 28 comprises a volume of a fluidized compressible material, such as rubber, which is poured or injected into the slot 52 and allowed to solidify. The volume of material which is provided in the slot 52 is selected such that in the solid form the seal member 26 has a portion 62' which extends axially beyond the opening 60 of the slot 52 to fully engage the axial face 62 of the boss 40.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

I claim:

1. A closure assembly for reducing leakage through an opening in a shipping and storage container, the closure assembly comprising:

a closure element having a longitudinal axis, the closure element having a first axial end receivable in the container opening and a second axial end with a peripheral flange outside the container when the first end is received in the container opening;

means operatively associated with said first axial end for releasably engaging the closure element with the container;

a slot on the peripheral flange having an axial opening which faces the container when the first end is received in the container opening, the slot having an end wall spaced axially from said opening and a pair of oppositely inclined sidewalls, the slot further having a depth characterized by the axial distance between the end wall and the opening; and a seal member disposed in the slot and having a first surface engaging the end wall and an arcuate surface extending axially through the opening, said arcuate surface being captured in sealing relation between the peripheral flange and the container when the closure element is engaged with the container.

2. The closure assembly of claim 1 in which the closure element is made of plastic.

3. The closure assembly of claim 1 in which the container opening is circular and the closure element has a cylindrical axial end receivable in the opening.

4. The closure assembly of claim 1 in which the means for releasably engaging the closure element with the container comprises a series of axially extending complementary threads on the first axial end of the closure element.

5. The closure assembly of claim 1 in which the peripheral flange is a radially extending annular flange having a substantially circular outer edge.

6. The closure assembly of claim 5 in which the outer edge of the peripheral flange is knurled.

7. The closure assembly of claim 1 in which the second axial end has a central opening which opens in a direction opposite the axially opening slot, the central opening having a series of peripherally spaced notches whereby appropriate tool means are receivable in the notches and can be used for disengaging the closure element from the container.

8. The closure assembly of claim 1 in which the seal member has a substantially circular cross section, the cross section of the seal member having a diameter greater than the depth of the axially opening slot whereby the arcuate surface has substantially circular curvature.

9. A fluid containment assembly comprising:

a substantially closed container having at least one opening;

a closure element having a longitudinal axis, the closure element having a first axial end received in the opening and a second axial end with a peripheral flange outside the container;

means operatively associated with said first axial end for releasably engaging the closure element with the container;

an axially opening slot on the peripheral flange, the slot having an end wall spaced axially from said opening and a pair of oppositely inclined sidewalls;

a seal member disposed in the slot, said seal member being captured in sealing relation between the peripheral flange and the containment container.

10. The fluid containment assembly of claim 9 in which the container is substantially cylindrical and has axially spaced ends with at least one opening in one of the ends.

11. The fluid containment assembly of claim 10 having an axially extending boss on one of the container ends for defining the opening through which fluids contained in the container are selectively discharged.

12. The fluid containment assembly of claim 11 in which the boss has a cylindrical internally threaded wall and the closure element has complementary external threads for effecting releasable engagement of the closure element with the container.

13. In a fluid containment assembly in which a closure element is releasably engaged with a shipping and storage container for selectively restricting the flow of fluid through an opening in the container, the closure element having a longitudinal axis with a first axial end received in the opening and a second axial end having a peripheral flange outside the container, the improvement comprising a closure assembly including an axially opening slot on the peripheral flange, the slot having a pair of spaced apart oppositely inclined sidewalls; and a seal member disposed in the axially opening slot and captured in sealing relation between the peripheral flange and the container for reducing leakage through the opening.

14. A closure assembly for reducing leakage through an opening in a shipping and storage container, the closure assembly comprising:

a closure element having a longitudinal axis, the closure element having a first axial end receivable in the container opening and a second axial end with a peripheral flange outside the container when the first end is received in the container opening;

engagement means operatively associated with said first axial end for releasably engaging the closure element with the container;

a downwardly opening slot on the peripheral flange, said slot having a pair of spaced apart oppositely inclined sidewalls;

a seal member disposed in the slot, said seal member being captured in sealing relation between the peripheral flange and the container when the closure element is engaged with the container; and retaining means associated with said peripheral flange for retaining the seal member in the slot before the closure element is engaged with the container.

15. The closure assembly of claim 14 in which the slot has an end wall and an elongated opening spaced axially from said end wall and which faces the container when the first end of the closure is received in the container opening, said seal member having a cross sectional dimension greater than the width of said opening whereby the sidewalls engage the seal member and retain the seal member in the slot.

16. The closure assembly of claim 15 in which the seal member has a first surface engaging the end wall of the slot and a second surface extending through the elongated opening.

* * * * *